US006024173A

United States Patent [19]

Patel et al.

[11] Patent Number: 6,024,173

[45] Date of Patent: Feb. 15, 2000

[54] INFLATABLE SHIFTING TOOL

[75] Inventors: Dinesh R. Patel, Sugar Land; Mike J. Griffith, Needville, both of Tex.

[73] Assignee: Schlumberger Technology Corporation, Sugar Land, Tex.

[21] Appl. No.: 09/034,206

[22] Filed: Mar. 3, 1998

[51] Int. Cl.[7] ..... E21B 34/10; E21B 34/14

[52] U.S. Cl. ..... 166/374; 166/321; 166/332.1; 166/334.2

[58] Field of Search ..... 166/332.1, 332.2, 166/332.3, 332.4, 334.2, 387, 386, 333.1, 332.5, 373, 374, 187; 251/292

[56] References Cited

U.S. PATENT DOCUMENTS

| | | | |
|---|---|---|---|
| 2,075,912 | 4/1937 | Roye | 166/187 |
| 4,215,746 | 8/1980 | Hallden et al. | 137/458 |
| 4,280,561 | 7/1981 | Fredd | 166/316 |
| 4,356,867 | 11/1982 | Carmody | 166/237 |
| 4,417,600 | 11/1983 | Kohn | 166/332.4 |
| 4,420,045 | 12/1983 | McMahan | 166/237 |
| 4,627,492 | 12/1986 | MacLaughlin | 166/152 |
| 4,979,569 | 12/1990 | Anyan et al. | 137/191 |
| 5,058,673 | 10/1991 | Muller er al. | 166/50 |
| 5,090,481 | 2/1992 | Pleasants et al. | 166/332.4 |
| 5,183,114 | 2/1993 | Mashaw, Jr. et al. | 166/319 |
| 5,263,683 | 11/1993 | Wong | 166/240 |
| 5,271,461 | 12/1993 | Decker et al. | 166/185 |
| 5,337,827 | 8/1994 | Hromas et al. | 166/321 |
| 5,518,073 | 5/1996 | Manke et al. | 166/321 |
| 5,664,629 | 9/1997 | Maitland | 166/321 |
| 5,810,087 | 9/1998 | Patel | 166/323 |

FOREIGN PATENT DOCUMENTS

| | | |
|---|---|---|
| 2 213 181 | 8/1989 | United Kingdom . |
| 2 228 028 | 8/1990 | United Kingdom . |
| 2 297 106 | 7/1996 | United Kingdom . |

OTHER PUBLICATIONS

Schlumberger, *Formation Isolation Valve* (*FIV*), p. 1 (Jan. 1997).

Schlumberger, *Liner Top Isolation Valve—LTIV,* p. 1 (Publication Date Unknown).

Schlumberger, *Formation Isolation Valve* (*FIV*), p. 1 (Aug. 1997).

Schlumberger, *Liner Top Isolation Valve—*(*LTIV**), p. 1 (Sep. 1997).

Schlumberger, *IRIS* Operated Dual Valve* (*IRDV–AB*), p. 1 (Oct. 1997).

Schlumberger, *Single–Shot Reversing Valve* (*SHRV*), p. 1 (Dec. 1996).

*Primary Examiner*—William Neuder
*Assistant Examiner*—John Kreck
*Attorney, Agent, or Firm*—Jeffrey E. Griffin; Jaime A. Castano; John J. Ryberg

[57] ABSTRACT

A shifting tool for moving a movable member attached to a device in a downhole tool includes a body having a bore and a feed port connected to the bore. A diaphragm is mounted on the body for radial expansion to engage the movable member. The diaphragm is coupled to the feed port and is configured to radially expand to engage the movable member when fluid is communicated through the feed port at a predetermined inflate pressure. A position locator is used to locate the downhole device such that the body is positioned to permit the diaphragm to radially expand to engage the movable member.

19 Claims, 6 Drawing Sheets

INFLATABLE SHIFTING TOOL

BACKGROUND OF THE INVENTION

Downhole tools frequently employ devices, such as ball and sleeve valves, that have slidable members that may be moved along the axial axis of a wellbore. A shifting tool that is run into the bore of the downhole tool may provide the mechanical motion to move the slidable member along the axis of the wellbore.

Typically, the shifting tool (shown in FIG. 1) has collets 100 which are mounted on a mandrel 104. The collets 100 are radially loaded with springs 102 so that they can move radially away from or towards the mandrel 104. The collets 100 are actuated radially away from the mandrel 104 to engage grooves in the slidable member when the shifting tool is positioned in the bore of the slidable member. Once the shifting tool engages the slidable member, force may be applied to the shifting tool to move the shifting tool and the slidable member along an axial direction of the downhole tool. The springs 102 holding the collets 100 to the mandrel 104 have limited radial expansion to ensure secure engagement of the collets in the grooves of the slidable member.

The outer diameter of the mandrel 104 is usually sized to pass through the smallest bore in the downhole tool encountered by the shifting tool before the shifting tool enters the bore of the slidable member. If the shifting tool is sized to pass through a bore having a much smaller inner diameter than the diameter of the bore of the slidable member, the collets 100 may be unable to expand far enough to engage the grooves in the slidable member. Thus, the shifting tool is typically limited to downhole tools that have consistent inside bore diameter throughout the length of the tool in which the shifting operations occur.

However, it may be desirable to have a downhole tool that has a restriction, such as flow meter venturi, nipple, or choke, with a bore that is much smaller than the bore of the slidable member. Thus, there is a need for a shifting tool that can pass through a small bore diameter and also engage a slidable member with a diameter much larger than the small bore diameter.

Other features will become apparent from the following description and from the claims.

SUMMARY OF THE INVENTION

In general, in one aspect, the invention features a shifting tool for engaging a movable device in a downhole tool which comprises a housing having a bore and an inflatable diaphragm mounted on the housing. A feed port is provided in the housing through which fluid may flow from the housing bore to inside the diaphragm to inflate the diaphragm to engage the movable device.

Other features will become apparent from the following description and from the claims.

DESCRIPTION OF THE PREFERRED EMBODIMENTS

Figure 2:
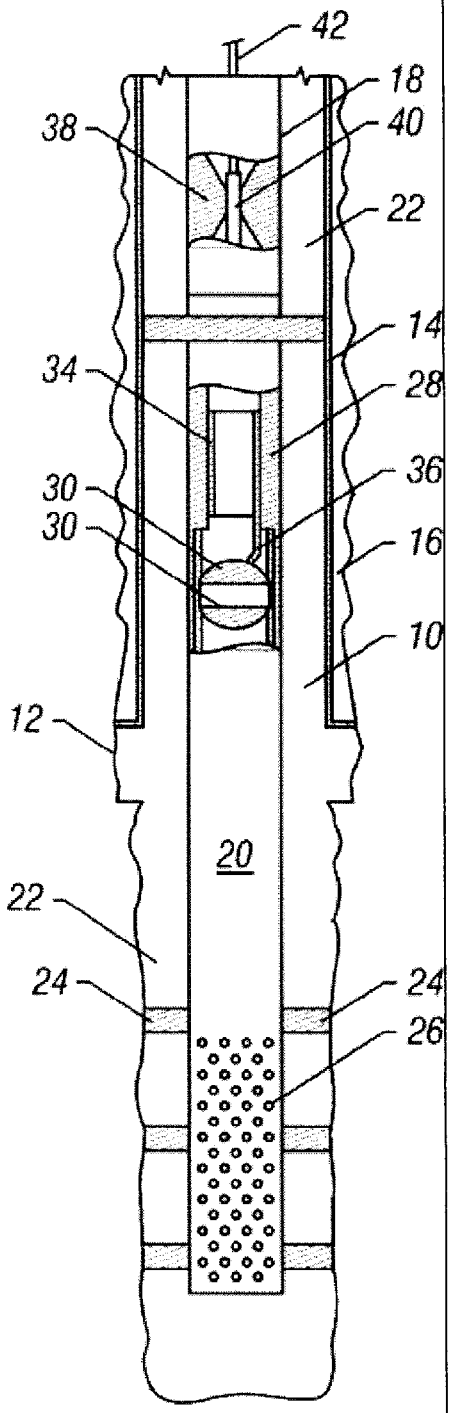
FIG. 2 is a schematic of a downhole tool suspended in a wellbore.

Referring to the drawings wherein like characters are used for like parts throughout the several views, FIG. 2 depicts a downhole tool 10 which is suspended in a wellbore 12. As shown a casing 14 generally extends along a portion of the length of the wellbore 12, leaving the balance of the wellbore 12 as an open hole. The casing 14 is held in place by cement sheath 16. While the wellbore 12 is shown as a vertical wellbore, it should be clear that the invention is equally applicable to horizontal and inclined wellbores.

The downhole tool 10 includes a tubing 18 which is connected to a pipe 20. The tubing 18 and the pipe 20 are concentrically received in the wellbore 12 such that an annular passage 22 is defined between the downhole tool 10 and the wellbore 12. Packers 24 are positioned along the wellbore to isolate sections of the annular passage 22. The pipe 20 includes perforations 26 for fluid communication from the annular passage 22 to the interior of the pipe 20. The bore of the tubing 18 is aligned with the bore of the pipe 20 such that fluid entering the pipe 20 may flow into the tubing 18.

Inside the pipe 20 is an isolation valve assembly 28. The isolation valve assembly 28 includes a ball valve 30 which has an axial bore 32 that may be aligned with the bore of the pipe 20 and the bore of the tubing 18 to permit fluid communication between the pipe 20 and the tubing 18. The isolation valve assembly 24 also includes a valve operator 34 that is movable along the longitudinal axis of the pipe 20. The valve operator 34 has an arm 36 that is connected to the ball valve 30.

The valve operator 34 can be moved downwardly to rotate the ball valve 30 to the open position such that the bore 32 is aligned with the bores of the tubing 18 and pipe 20. In this open position, fluid can be communicated between the tubing 18 and the pipe 20. The valve operator 34 can also be moved upwardly to rotate the ball valve 30 to the closed position such that the bore 32 is out of alignment with the bores of the tubing 18 and the pipe 20. In this closed position, fluid communication between the tubing 18 and the pipe 20 is prevented.

A flow restricting member 38 (e.g. a flow meter venturi) is disposed in the tubing 18 above (or ahead of) the isolation valve assembly 28. The flow restricting member 38 has an inner bore diameter that is smaller than the inner diameter of the valve operator 34.

A shifting tool 40 is run into the downhole tool 10 on the end of a coiled tubing 42. The shifting tool 40 is sized to pass through the flow restricting member 34. The shifting tool 40 may be hydraulically actuated to engage the valve operator 34. When the shifting tool 40 engages the valve operator 34, force may be applied to the shifting tool 40 to move the valve operator 34.

Figure 3:
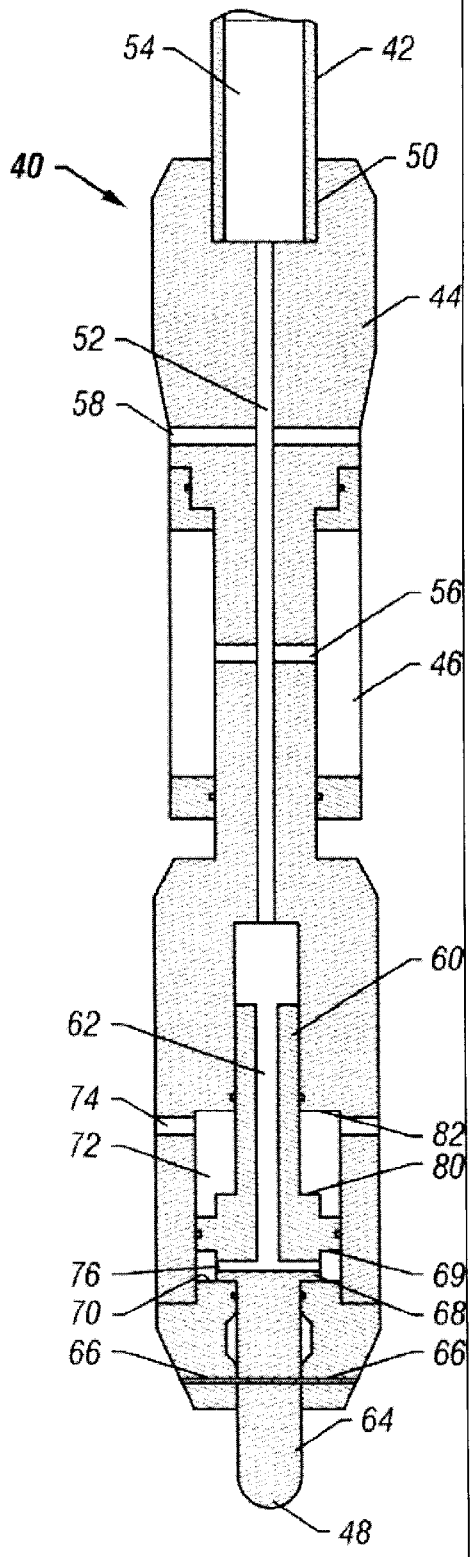
FIG. 3 is a vertical cross-section view of a shifting tool according to the invention.

Referring to FIG. 3, the shifting tool 40 includes a mandrel 44, an inflatable packer or diaphragm 46, and a retractable bull nose 48. The outer diameter of the mandrel 44 is sized to enter the bore of the flow restricting member 38 in the tubing 18. The upper end of the mandrel 44 includes a receptacle 50 for threadedly engaging an end of the coiled tubing 42. The mandrel 44 also has a bore 52 which is aligned with the bore 54 of the coiled tubing 42. The inflatable packer 46 is mounted on the mandrel 44. Ports 56 are provided in the mandrel 44 through which fluid may be supplied from the bore 52 of the mandrel 44 to the packer 46 to inflate the packer 46. Ports 58 are also provided in the mandrel 44 to allow the fluid supplied to the packer 46 to be exhausted, and thereby deflate the packer 46.

Inside the mandrel 44 is a piston 60 which has a bore 62 that is aligned with the mandrel bore 52. The upper end of the bull nose 48 is attached to the piston 60. The lower end 64 of the bull nose 48 is secured to the mandrel 44 by shear pins 66. The piston 60 is also locked in place in the mandrel 44 by virtue of the shear pins 66 holding the bull nose 48 to the mandrel 44. A ridge 68 at the upper end of the bull nose 48 rests on a lower collar 70 in the mandrel 44 so that the bull nose 48 does not fall out of the mandrel 44 when the shear pins 66 are sheared.

The piston 60 is exposed to fluid pressure when fluid flows into a chamber 72 through ports 74. In addition, ports 76 are provided at the lower end of the piston 60 through which fluid pressure in the bore 52 of the mandrel 44 may be communicated to a lower shoulder 69 of the piston 60. The pressure acting on the shoulder 69 tends to move the piston 60 up, but the shear pins 66 keep the piston 60 from moving. The bull nose 48 only moves when the pressure communicated to the shoulder 69 exerts enough force on the bull nose 48 to shear the shear pins 66. When the shear pins 66 are sheared, the bull nose 48 and the piston 60 move upwardly until a top shoulder 80 of the piston 60 contacts an upper collar 82 in the mandrel 44.

Figure 4:
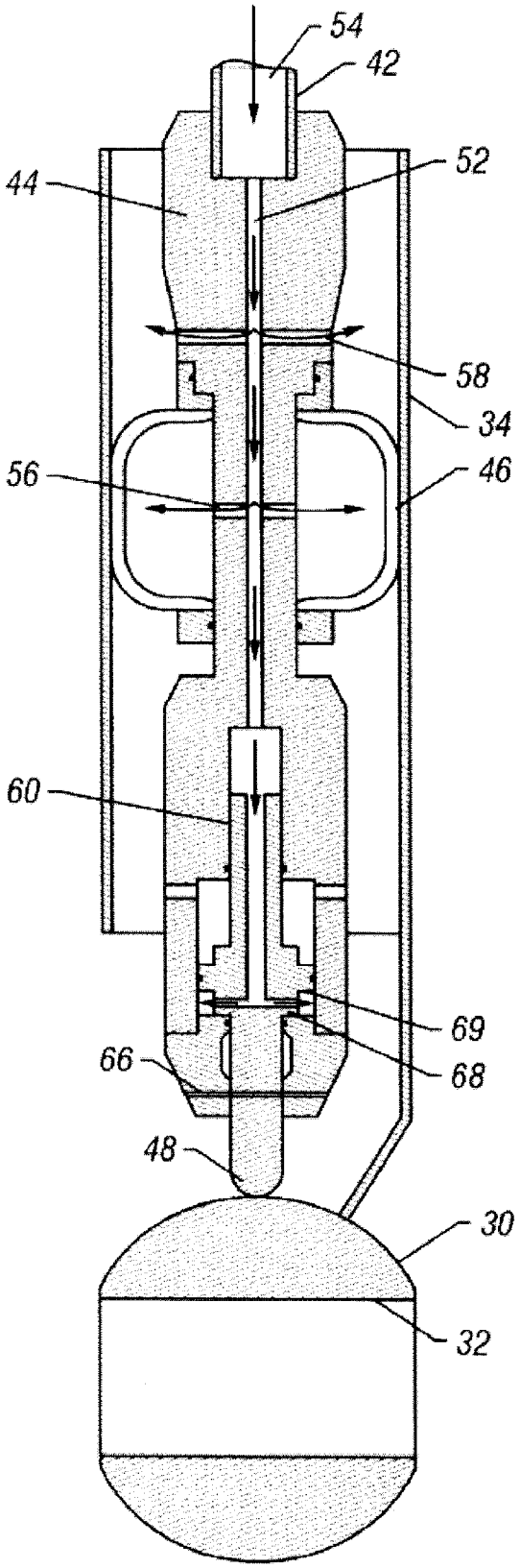
FIG. 4 shows the shifting tool of FIG. 3 engaging a valve operator.

In operation, the shifting tool 40 is lowered into valve operator 34 until the bull nose 48 touches the top of the closed ball valve 30, as shown in FIG. 4. The bull nose 48 is used to locate the top of the closed ball valve 30. The shifting tool 40 is lowered to the ball valve 30 with the packer 46 uninflated so that the shifting tool 40 can pass through the bore of the flow restricting member 38. The shear pins 66 have a high shear value so that they do not shear when the bull nose 48 lands on the ball valve 30.

After establishing the depth of the ball valve 30 (i.e. when the bull nose 48 of the shifting tool contacts the ball valve 30), the packer 46 is inflated by pumping fluid from the surface through the bores 52 and 54 and ports 56 at a rate sufficient to maintain a desired inflate pressure in the packer 46. The pumped fluid leaks out of the ports 58. However, if sufficient fluid is pumped down the bore 52 and 54, some of it continues down to ports 56. Thus, the pumping rate must be set at a rate higher than the leak rate of ports 58 to maintain the inflate pressure in the packer 46.

At the proper inflate pressure, the outer wall of the packer 46 expands to contact and press hard against the inner wall of the valve operator 34. The same inflate pressure expanding the packer 46 is also acting on the shoulder 69 of the piston 60 and tends to move the bull nose 48 upwardly. However, the bull nose 48 does not move up at this point because it is held to the mandrel 44 by the shear pins 66.

Figure 5:
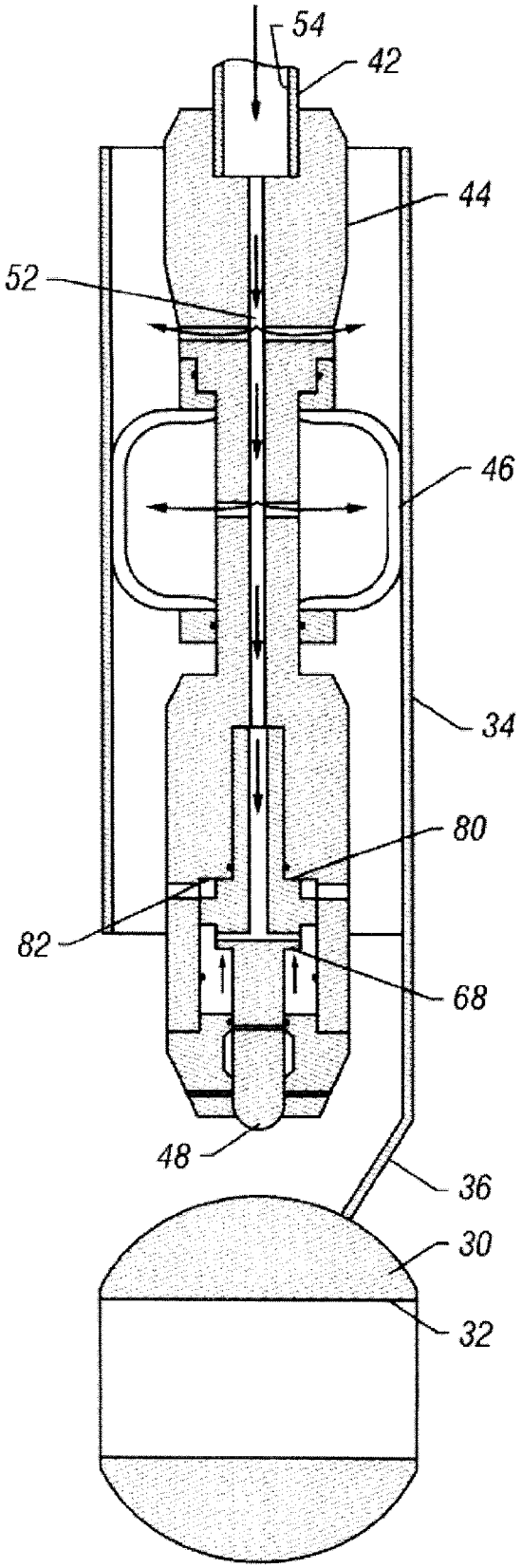
FIG. 5 shows the shifting tool of FIG. 4 with the bull nose in the retracted position.

Once the inflatable packer 46 has engaged the valve operator 34, the pressure in the bore 52 is increased by increasing the rate at which fluid is pumped into the bore 52. This pressure increase is sufficient to create an upward force on the shoulder 69 that shears the shear pins 66. When the shear pins 66 are sheared, the force acting on the shoulder 69 moves the piston 60 and bull nose 48 upwardly. The piston 60 stops its upward motion when it contacts the upper collar 82 in the mandrel 44, as shown in FIG. 5. The pressure acting on the shoulder 69 of the piston 60 and the ridge 68 of the bull nose 48 maintains the bull nose 48 in this retracted position.

Figure 1:
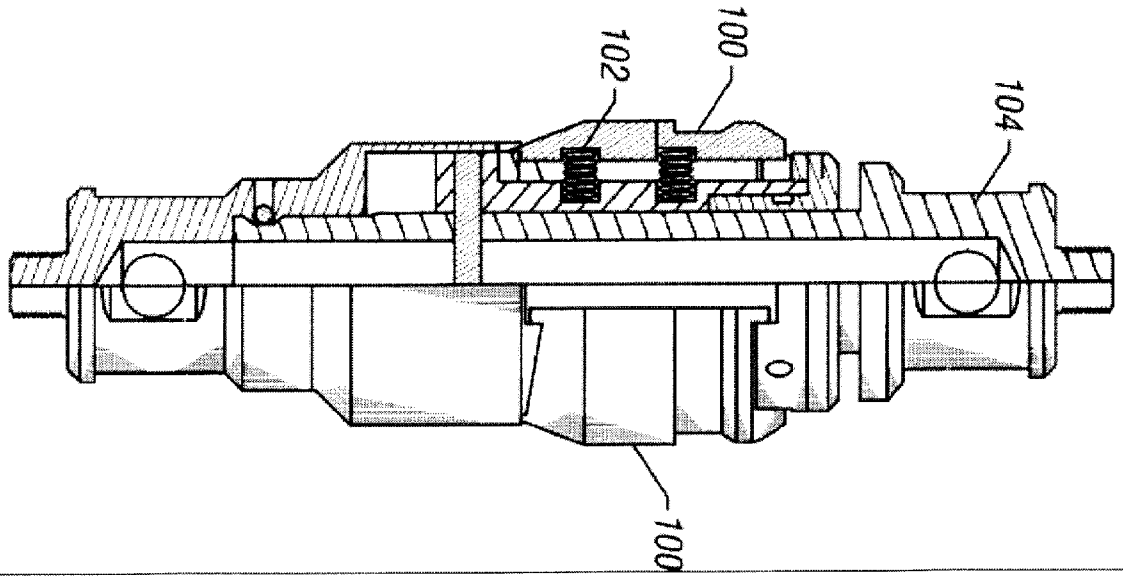
FIG. 1 (Prior Art)
FIG. 1 is a schematic of a prior art shifting tool.

The shifting tool 40 is run lowered into the valve operator 34 on the end of the coiled tubing 42, which is supported at the surface (not shown). Because the outer diameter of the coiled tubing 42 is smaller than the inner diameter of the tubing 18 (see FIG. 1), the coiled tubing 42 buckles as the shifting tool 40 is lowered into the valve operator 34. The buckling of the coiled tubing 42 exerts a downward force on the shifting tool 40.

The retraction of the bull nose 48 inside the mandrel 44 creates a gap between the bottom of the shifting tool 40 and the top of the ball valve 30. The downward force on the shifting tool 40 due to the buckling of the coiled tubing 42 attempts to push the shifting tool down, but the friction between the outer wall of the packer 46 and the inner diameter of the valve operator 34 does not allow the shifting tool 40 to move down. The frictional force generated due to inflate pressure is higher than any downward push that may be present when the pins 66 are sheared and the bull nose 48 is retracted inside the mandrel 44.

Figure 6:
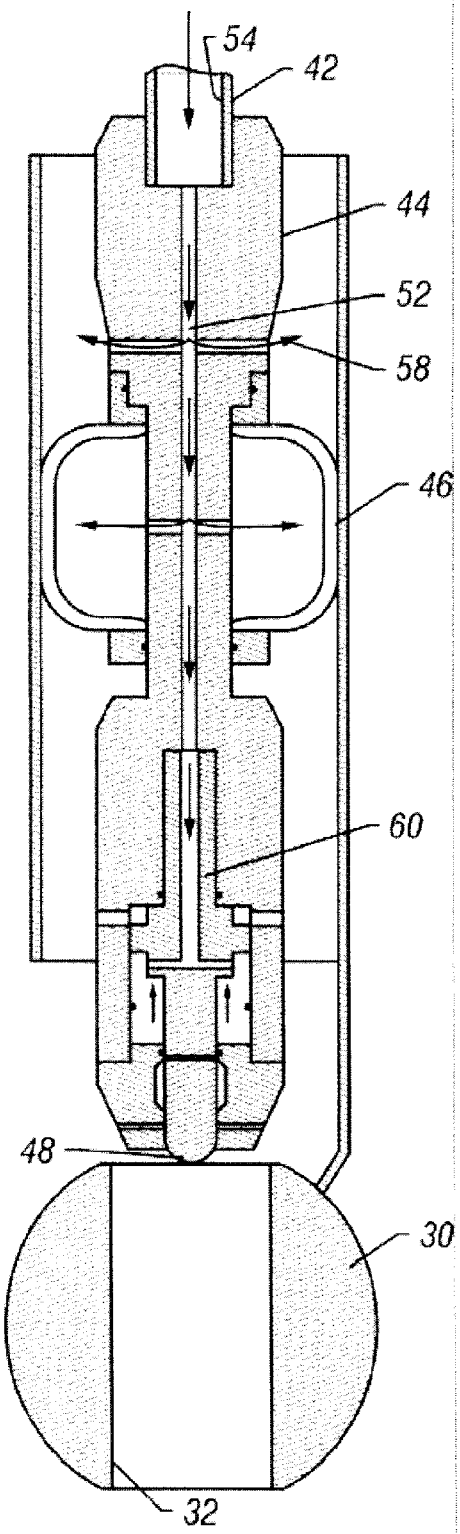
FIG. 6 shows the shifting tool of FIG. 5 opening a ball valve.

Because the inflated packer 46 effectively couples the shifting tool 40 to the valve operator 34, the shifting tool 40 and the valve operator 34 move down together when weight is applied on the shifting tool 40. The downward travel of the valve operator 34 opens the ball valve 30, as shown in FIG. 6. The gap that is created between the bottom of the shifting tool 40 and the top of the ball valve 30 (see FIG. 5) by the retraction of the bull nose 48 allows the shifting tool 40 and the valve operator 34 to move down to rotate the ball valve 30 to the open position.

Once the ball valve 30 is opened, the pumping of fluid into the coiled tubing 42 is stopped. Fluid in the packer 46 bleeds out through the ports 56 and 58 until the packer 46 deflates to its original uninflated position. Then the shifting tool 40 is retrieved through the small diameter of the flow restricting member 38 above the ball valve 30.

It should be clear that the shifting tool 40 may also be used to close the isolation valve 28 by reversing the shift direction of the shifting tool 40 and valve operator 34. For instance, the ball valve 30 can be closed by operating the shifting tool 40 to engage the valve operator 34 and moving the shifting tool 40 and the valve operator 34 up to rotate the ball valve 30 to the closed position. When closing the ball valve 30 with the shifting tool 40, other depth correlation tools may be used to correlate the bottom of the shifting tool 40 to the top of the valve 30 such that the shifting tool 40 is positioned in the valve operator 34 before the packer 46 is inflated.

Other embodiments are also within the scope of the following claims. The shifting tool 40 may also be used to operate sleeve valves or other downhole devices requiring axial mechanical motion to operate them. The shifting tool 40 may also be lowered downhole on the end of a drill pipe.

While the present invention has been described with respect to a limited number of preferred embodiments, those skilled in the art will appreciate numerous modifications and variations therefrom. The appended claims are intended to cover all such modifications and variations which occur to one of ordinary skill in the art.

What is claimed is:

1. A downhole tool for use in a wellbore, comprising:

an actuatable device;

a movable member coupled to actuate the actuatable device; and a shifting tool having an inflatable packer that when inflated engages the movable member to allow movement of the shifting tool to move the movable member.

2. The downhole tool of claim 1, wherein the movable member includes a bore in which the shifting tool can fit, and wherein inflation of the packer causes it to press against an inner wall defined in the bore of the movable member.

3. The downhole tool of claim 1, further comprising a second device positioned ahead of the actuatable device, a bore in the second device having a diameter less than that of a bore in the actuatable device, wherein the shifting tool passes through the second device bore before reaching the actuatable device.

4. The downhole tool of claim 3, wherein the second device includes a flow restriction member.

5. The downhole tool of claim 1, further comprising:

a tubing having a bore, wherein the shifting tool includes a bore aligned with the tubing bore, the shifting tool further including a feed port coupled to the inflatable packer, and wherein fluid pumped down the tubing bore can flow through the feed port to inflate the packer.

6. The downhole tool of claim 1, wherein the actuatable device includes a ball valve.

7. The tool of claim 1, wherein the movable member includes a valve operator.

8. A shifting tool for a movable member attached to a device in a downhole tool, comprising:

a body having a bore and a feed port connected to the bore;

a diaphragm mounted on the body and coupled to the feed port, the diaphragm being adapted to radially expand upon communication of fluid through the feed port at a predetermined inflate pressure; and a position locator including a tip member that locates the device such that the body is located in a position to permit the diaphragm to radially expand to engage the movable member, the tip member being retractable in response to applied fluid pressure.

9. The shifting tool of claim 8, wherein the bore is aligned with a flow conduit.

10. The shifting tool of claim 8, wherein the tip member is adapted to retract in the presence of applied fluid pressure greater than the inflate pressure.

11. The shifting tool of claim 8, wherein the tip member is attached to the body by a shearable member.

12. The shifting tool of claim 8, wherein the tip member is adapted to contact the device for depth correlation.

13. The shifting tool of claim 8, wherein the shifting tool provides a gap between the device and the distal end of the shifting tool upon retraction of the tip member.

14. The shifting tool of claim 8, wherein the shifting tool is adapted to operate the device in response to an applied axial force.

15. A method of actuating a device in a downhole tool located in a wellbore, the method comprising:

lowering a shifting tool into the downhole tool, the shifting tool having an inflatable packer;

positioning the shifting tool in a bore of the device;

inflating the packer to engage the device; and moving the shifting tool to actuate the device.

16. The method of claim 15, wherein a tubing is connected to the shifting tool, the method further comprising pumping fluid through the tubing at a predetermined pressure to inflate the packer.

17. The method of claim 16, wherein the shifting tool further includes outlet ports, the method further comprising deflating the packer by allowing fluid in the packer to escape through the outlet ports.

18. The method of claim 15, wherein the downhole tool includes a member having an inner bore that has a smaller diameter than the bore of the device, the method further comprising passing the shifting tool through the member bore before reaching the device.

19. The method of claim 15, wherein actuating the device includes actuating an operator of a valve.

* * * * *